United States Patent [19]

Smith

[11] Patent Number: 4,773,242

[45] Date of Patent: Sep. 27, 1988

[54] LOCK CYLINDER COVER WITH TIME DELAY CLOSURE

[75] Inventor: Dennis E. Smith, Southfield, Mich.

[73] Assignee: General Motors Corporation, Detroit, Mich.

[21] Appl. No.: 14,242

[22] Filed: Feb. 17, 1988

[51] Int. Cl.[4] ..... E05B 17/18

[52] U.S. Cl. ..... 70/455; 70/423; 70/427; 70/DIG. 48; 16/82

[58] Field of Search ..... 70/423, 427, 455, DIG. 48; 16/82

[56] References Cited

U.S. PATENT DOCUMENTS

| | | | |
|---|---|---|---|
| 2,036,541 | 4/1936 | Ringseis | 70/455 X |
| 2,213,814 | 9/1940 | Jacobi | 70/455 |
| 2,388,228 | 10/1945 | Johnstone | 70/455 |
| 3,898,824 | 8/1975 | Borlinghaus | 70/455 |
| 3,930,391 | 1/1976 | Borlinghaus | 70/455 |
| 4,192,161 | 3/1980 | Borlinghaus | 70/455 |
| 4,426,752 | 1/1984 | Nakayama | 16/82 |
| 4,468,836 | 9/1984 | Omata | 16/82 |
| 4,527,675 | 7/1985 | Omata et al. | 16/82 X |
| 4,586,355 | 5/1986 | Lee et al. | 70/455 |
| 4,597,274 | 7/1986 | Coscia et al. | 70/455 |
| 4,614,004 | 9/1986 | Oshida | 16/82 |
| 4,638,528 | 1/1987 | Omata | 16/82 |
| 4,674,308 | 6/1987 | Peters | 70/455 |
| 4,723,428 | 2/1988 | Yamaguchi | 70/423 X |

FOREIGN PATENT DOCUMENTS

| | | | |
|---|---|---|---|
| 0209747 | 1/1987 | European Pat. Off. | 70/455 |

*Primary Examiner*—Robert L. Wolfe
*Assistant Examiner*—Suzanne L. Dino
*Attorney, Agent, or Firm*—Charles E. Leahy

[57] ABSTRACT

A deck lid latch has a rotatable clock cylinder accessible through an escutcheon having a pivotally mounted cover. A detent is effective upon movement of the cover to the open position to hold the cover in the open position. The detent is released in response to rotation of the lock cylinder so that the cover is moved to the closed position by a bias spring. A gear is rotatably mounted on the escutcheon and has gear teeth meshing with gear teeth displayed on the cover in an arcuate path about the pivot axis of the cover so that pivotal movement of the cover rotates the gear. A viscous damper is associated with the gear to retard rotary movement of the gear and thereby retard the closing movement of the cover in a time delayed fashion which gives the operator time to withdraw the key and his fingers from proximity with the spring biased cover prior to the cover reaching the closed position.

1 Claim, 1 Drawing Sheet

2

LOCK CYLINDER COVER WITH TIME DELAY CLOSURE

The invention relates to a lock cylinder cover for an automotive deck lid and more particularly provides a viscous damper for retarding the rate of movement of the cover to the closed position.

BACKGROUND OF THE INVENTION

It is well known in motor vehicle bodies to employ a key operated lock cylinder for locking a deck lid in the closed position. The lock cylinder is conventionally concealed beneath an escutcheon. A cover is rotatably mounted on the escutcheon and spring loaded for pivotal return toward a closed position overlying the escutcheon and concealing the lock cylinder from view.

Prior patents such as U.S. Pat. Nos. 3,898,824, 3,930,391 and 4,192,161, invented by Hans J. Borlinghaus, and assigned to the assignee of this invention, have proposed a detent which retains the cover in the open position. According to these patents the detent is mounted on the escutcheon and engages with the cover when the cover is moved to the open position to hold the cover at the open position in which the lock cylinder is fully exposed for insertion of the key. Upon rotation of the key to the unlocking position, the detent is released and in turn releases the cover for a return to the closed position by the action of a biasing spring acting between the cover and the escutcheon.

A disadvantage of the prior lock cylinder covers is that the rotation of the key initiates release of the cover to the closed position so that the rapid closing movement of the cover by the bias spring may annoy the vehicle operator by striking the operator's fingers before the key can be fully withdrawn from the lock cylinder.

Accordingly, it would be desirable to provide a device for retarding the closing movement of the cover until the key and fingers are removed from proximity with the cover.

The present invention provides a new and improved lock cylinder cover in which a viscous damper acts between the cover and the escutcheon to delay the closing movement of the cover and thereby facilitate removal of the key and fingers from proximity with the spring biased cover.

SUMMARY OF THE INVENTION

According to the invention the rotatable lock cylinder has a key slot accessible through an escutcheon having a pivotally mounted cover movable between an open position and a closed position. A detent is effective upon movement of the cover to the open position to hold the cover in the open position. The detent is released in response to rotation of the lock cylinder so that the cover is released for movement to the closed position by a bias spring. A gear is rotatably mounted on the escutcheon and has gear teeth meshing with gear teeth displayed on the cover in an arcuate path about the pivot axis of the cover so that pivotal movement of the cover rotates the gear. A viscous damper is associated with the gear to retard rotary movement of the gear and thereby retard the closing movement of the cover in a time delayed fashion which gives the operator time to withdraw the key and his fingers from proximity with the spring biased cover prior to the cover reaching the closed position which might pinch the occupant's finger.

BRIEF DESCRIPTION OF THE DRAWINGS

These and other objects, features and advantages of the invention will become apparent upon consideration of the specification and the appended drawings in which.

DESCRIPTION OF THE PREFERRED EMBODIMENT

Figure 1:
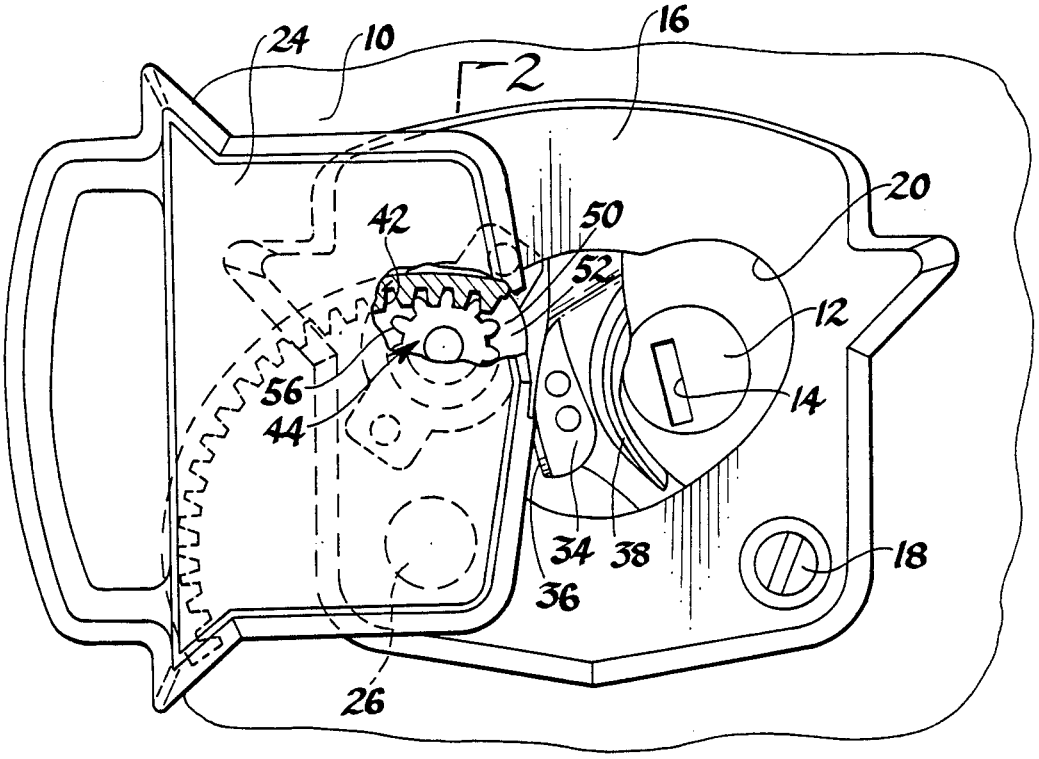
FIG. 1 is a frontal elevation view of a lock cylinder cover according to the invention and showing the lock cover retained in the open position by a detent.

FIG. 1 illustrates a vehicle deck lid 10 including a conventional lock cylinder 12 having a key slot 14. When a key, not shown, is inserted into the key slot 14, the key cylinder 12 may be rotated to operate a deck lid latch, not shown.

A lock cylinder cover arrangement includes an escutcheon 16 suitably secured to the deck lid 10 as by a screw 18 and an additional screw, not shown. The escutcheon 16 has an opening 20 which registers with the lock cylinder 12.

Figure 2:
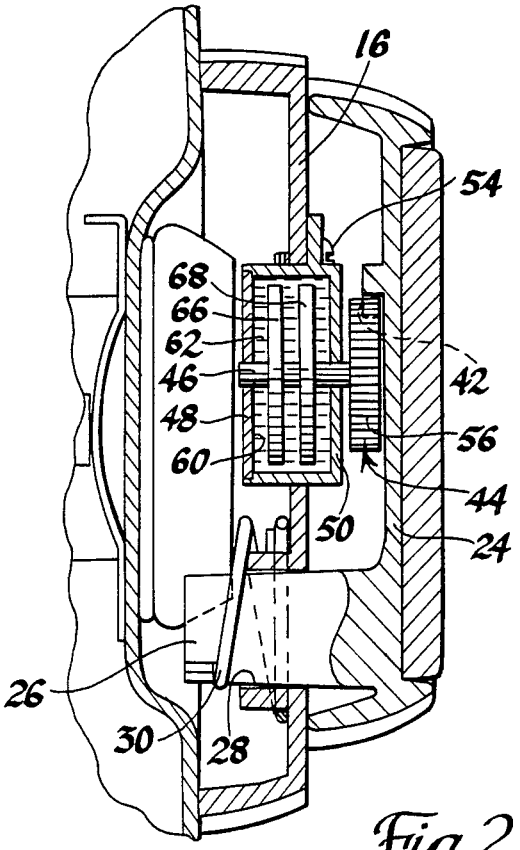
FIG. 2 is a section view taken in the direction of arrows 2—2 of FIG. 1.
Figure 3:
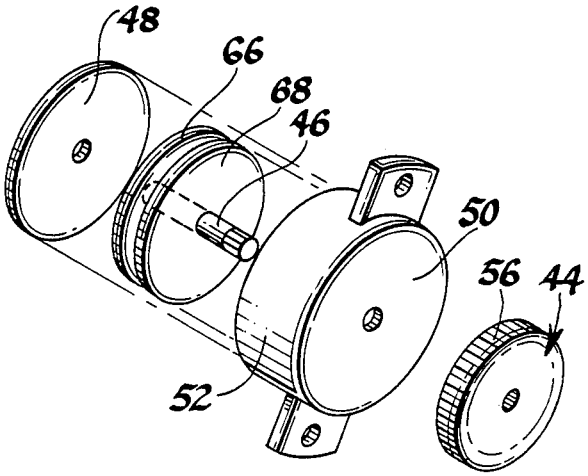
FIG. 3 is an exploded perspective view of the viscous damper acting between the escutcheon and the cover.

A cover 24 overlies the escutcheon 16 and is pivotally mounted thereon by a pivot shaft 26 of the cover 24 which extends through a pivot opening 28 of the escutcheon 16 as best seen in FIG. 2. A torsion spring 30 encircles the pivot shaft 26 and has one end anchored on the pivot shaft 26 and the other end anchored on the escutcheon 16. The spring 30 acts to bias the cover 24 in the clockwise direction about the pivot axis provided by the pivot shaft 26 and toward a closed position registering with the escutcheon 16.

As best seen in FIG. 1, a detent mechanism includes a detent arm 34 having a shoulder 36 which engages with the cover 24 to retain the cover 24 in the open position of FIG. 1. The detent arm 34 has a cam surface 38 which is engageable by the key when the key is rotated to unlock the lock cylinder. The head of the key rides along the cam 38 and flexes the detent 34 so that the shoulder 36 of the detent 34 is withdrawn from engagement with the escutcheon 16. Accordingly, in response to such rotation of the key cylinder, the cover 24 is released by the detent and is permitted to rotate clockwise under the bias of the spring 30.

A viscous damping mechanism is provided for retarding the closing movement of the cover 24 by the spring 30. As bestseen in FIG. 1, a plurality of gear teeth 42 are integrally formed on the underside of the cover 24 in an arcuate path about the pivot axis provided by the pivot shaft 26. A gear 44 is mounted on the escutcheon 16 by a shaft 46 which is journaled in spaced apart walls 48 and 50 of a sealed housing 52. The sealed housing 52 is suitably mounted on the escutcheon 16 as by a screw 54. The gear 44 has gear teeth 56 which mesh with the gear teeth 42 on the cover. The housing 52 defines a fluid chamber 60 which is filled with a viscous fluid 62. A pair of plates 66 and 68 are attached to the shaft 46 and suspended in the viscous fluid 62.

Referring to FIGS. 1 and 2, it will be appreciated that the viscosity of the fluid 62 provided in the housing 52 will impede the rotation of the plates 66 and 68 and thereby control the rate of closing movement of the cover 24. Rotary movement of the lock cylinder 12 by the key releases the detent so that the detent shoulder 36 is disengaged from the cover 24. The bias spring 30 initiates clockwise pivoting movement of the cover 24 toward the closed position. However, rather than snapping closed, the closing movement of the cover 24 is controlled by the viscous damping action of the viscous fluid 62 on the plates 66 and 68 because the gear 44 meshing with the gear teeth 42 on the cover will retard the closing movement of the cover 24. By tuning the viscous clutch 62 and/or the plates 66 and 68, the rate of closing movement of the cover 24 can be sufficiently retarded to introduce a time delay which enables the user adequate time to withdraw the key and his fingers prior to the cover 24 coming into annoying engagement with the fingers or the key.

Thus, it will be appreciated that the invention provides a new and improved key cover for a deck lid latch in which a viscous fluid damping mechanism retards the closing movement of the lock cylinder cover.

The embodiments of the invention in which an exclusive property or privilege is claimed are defined as follows:

1. In a rotatable lock cylinder arrangement for locking a deck lid and having an escutcheon with a pivotally mounted cover movable between an open position uncovering a key slot of the lock cylinder for insertion of a key to rotate the lock cylinder and a closed position covering the lock cylinder, a detent for the cover comprising:

detent means effective upon movement of the cover to the open position to hold the cover in the open position;

release means effective in response to rotation of the lock cylinder to release the detent so that the cover is released for movement to the closed position;

spring means acting between the cover and the escutcheon to bias the cover to the closed position;

a rack of gear teeth formed integrally on the cover and displayed in an arcuate path about the pivot axis of the cover on the escutcheon;

a gear rotatably mounted on the escutcheon and having gear teeth meshing with the gear teeth of the cover so that pivotal movement of the cover rotates the gear; and viscous damping means associated with the gear to retard rotary movement of the gear and thereby retard the cover closing movement and thereby facilitate the removal of the key from the lock cylinder by providing time delayed movement of the cover to the closed position by the spring means.

* * * * *